US006385333B1

(12) United States Patent
Puckett et al.

(10) Patent No.: US 6,385,333 B1
(45) Date of Patent: May 7, 2002

(54) CIGARETTE INSPECTION DEVICE

(75) Inventors: Douglas Puckett, Hayes, VA (US); Gil Juarez, Abbeville, SC (US); Donald H. Jones, Midlothian; Jeff Swepston, Powhatan, both of VA (US); Charles W. Harris, Chesterfield, VA (US)

(73) Assignee: Philip Morris Incorporated, New York, NY (US)

( * ) Notice: Subject to any disclaimer, the term of this patent is extended or adjusted under 35 U.S.C. 154(b) by 0 days.

(21) Appl. No.: 09/577,170

(22) Filed: May 24, 2000

(51) Int. Cl.[7] ..... G06K 9/100

(52) U.S. Cl. ..... 382/143; 356/237.1

(58) Field of Search ..... 382/141, 143; 348/86, 125; 700/95, 212; 209/509; 356/430, 237.1, 237.2, 237.3; 250/237, 559.42; 131/280, 76, 88

(56) References Cited

U.S. PATENT DOCUMENTS 4,238,993 A 12/1980 Brand et al. ..... 131/280
4,284,088 A 8/1981 Brand et al. ..... 131/280
4,962,771 A * 10/1990 Neri et al. ..... 131/282
4,972,494 A * 11/1990 White et al. ..... 382/143
5,209,249 A * 5/1993 Neri ..... 131/282
5,232,079 A * 8/1993 Belcastro et al. ..... 198/370.1
5,432,600 A * 7/1995 Grollimund et al. ..... 356/237.2
5,472,078 A 12/1995 Hoffmann et al. ..... 198/431
5,499,636 A * 3/1996 Baggett, Jr. et al. ..... 131/374
5,902,501 A * 5/1999 Nunnally et al. ..... 219/263
6,169,600 B1 * 1/2001 Ludlow ..... 356/237.1

* cited by examiner

*Primary Examiner*—Samir Ahmed
(74) *Attorney, Agent, or Firm*—Connolly Bove Lodge & Hutz LLP

(57) ABSTRACT

A cigarette inspection device includes four sensors, two for sensing the ends and one for sensing the middle portion of a cigarette to detect loose tobacco and filter presence at the ends, and the presence of a foil band at the middle portion. The fourth sensor provides machine timing information to determine the three conditions of detection. Binary information is then input to a PLC for data reduction and rejection, if the conditions are not present. The program in the PLC allows the end of the cigarette to be scanned multiple times for loose tobacco. Also, foil sensing and filter sensing are done along with the loose tobacco sensing. A shift register is loaded with the resultant detection data, and a reject valve or similar device is operated to remove faulty cigarettes from the product stream.

4 Claims, 6 Drawing Sheets

CIGARETTE INSPECTION DEVICE

BACKGROUND OF THE INVENTION

The present invention relates to a cigarette inspection device, and more particularly to a device that senses the opposite ends of a cigarette for loose tobacco ends and the presence of a filter, and also senses the middle portion for a non-ferrous foil ring.

SUMMARY OF THE INVENTION

Among the objects of this invention is a cigarette inspection device for efficiently and reliably detecting defects in the individual cigarettes of a high speed product stream and removing defective cigarettes from the stream.

In accordance with the present invention, a cigarette inspection device for inspecting individual cigarettes of a high speed product stream comprises an inspection station and structure for moving cigarettes through the inspection station. The station includes a first sensor for scanning one end of the cigarette for loose tobacco ends and producing a reject signal when loose ends are detected. A second sensor scans the other end of the cigarette for the presence of a cigarette filter and produces a reject signal when the cigarette filter is missing. A third sensor scans the middle portion of the cigarette for the presence of a non-ferrous metal foil band and produces a reject signal when the band is missing. The cigarette inspection device further includes a fourth sensor for providing machine timing information to effect rejection and removal of any faulty cigarettes from the product stream.

Preferably the first, second and third sensors each make at least six scans on each cigarette. Moreover, the first and second sensors preferably comprise fiber optic sensors, while the third and fourth sensors preferably comprise inductive sensors. Also, the first, second and third sensors may inspect in any order.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawing wherein similar reference characters refer to similar parts and in which.

DETAILED DESCRIPTION OF THE INVENTION

Figure 1:
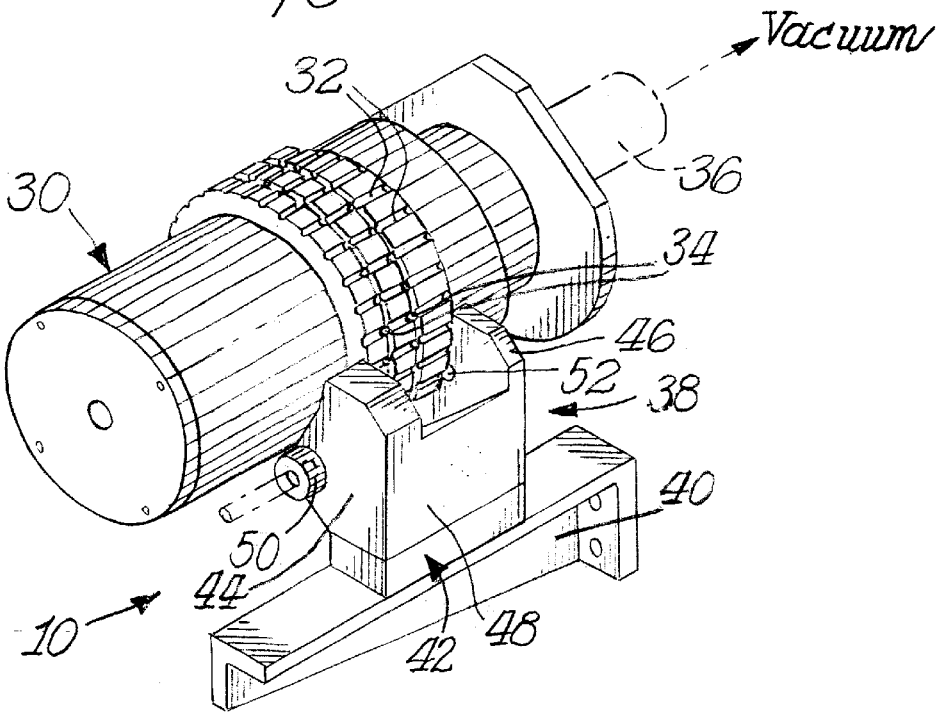
FIG. 1 is a perspective view of an assembly for inspecting cigarettes for loose tobacco ends, missing filters and missing metal bands, according to the present invention.
Figure 4:
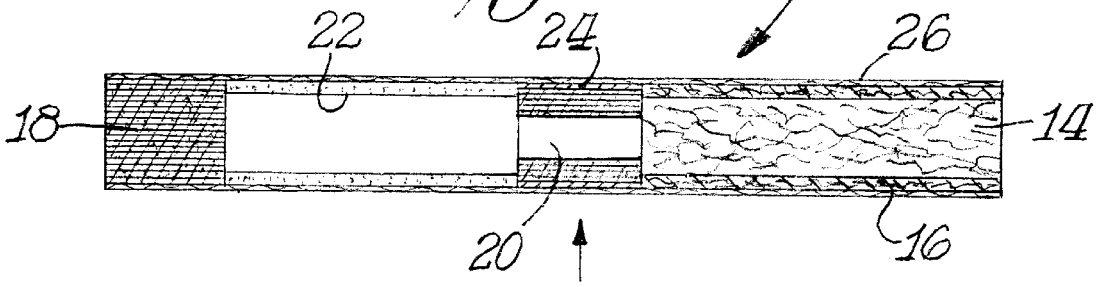
FIG. 4 is a cross-sectional view in elevation of a cigarette being inspected by the assembly of FIGS. 1, 2 and 3.
Figure 3:
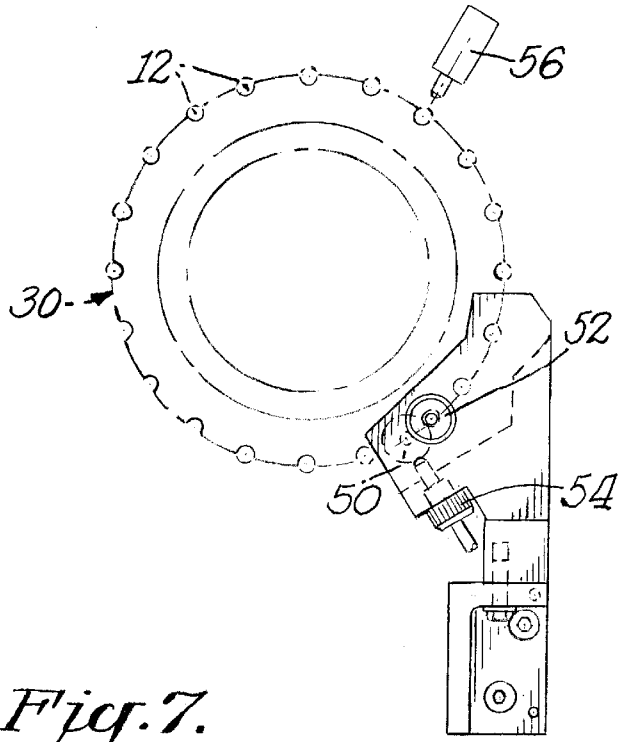
FIG. 3 is a right side elevational view of the assembly shown in FIGS. 1 and 2.
Figure 2:
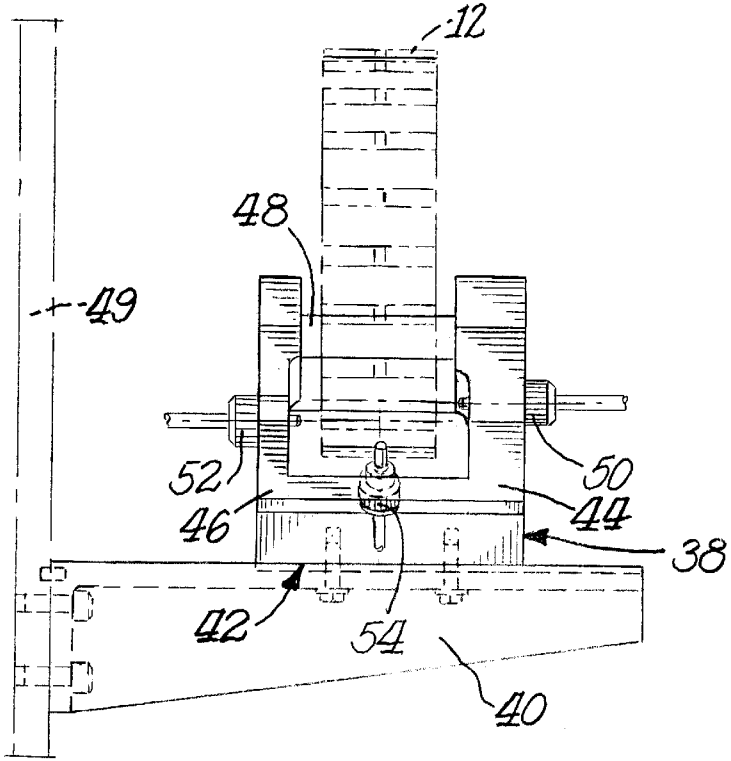
FIG. 2 is a rear elevational view of the assembly shown in FIG. 1.

Referring in more particularity to the drawings, FIGS. 1–3 show a cigarette inspection device 10 for inspecting individual components of a cigarette 12 and determining any defects therein. Although inspection device 10 is capable of inspecting a variety of cigarette constructions, cigarette 12 and the individual components thereof are described herein.

Cigarette 12 fundamentally includes an inner rod of loose tobacco 14 surrounded by an outer layer of packed or tobacco mat 16. The tip end of cigarette 12 includes a tip filter 18 of cellulose acetate, and an upstream cellulose acetate filter 20 is generally positioned in the middle of the cigarette. Filter 20 may be in the form of a hollow acetate tube. A cylindrical sleeve 22 which also may be in the form of a hollow acetate tube spaces the filters from one another, as shown. A non-ferrous metal foil band 24 surrounds the middle filter 20, and an outer wrap 26 of paper completes the cigarette construction.

Cigarette 12 is primarily used in smoking machines that produce little, if any, smoke during the smoking process. The cigarette is inserted into the machine and after periodic heat scoring on the outside at the tobacco end, the user periodically draws on the machine. In order to prevent use of ordinary cigarettes in such smoking machines, the machine initially senses the presence of the non-ferrous metal foil band 24 before the smoking process. If the band is not present, the smoking machine will not operate.

Device 10 inspects cigarettes 12 to determine:

(1) if tip filter 18 is present on the cigarette;

(2) if the tobacco present in the tobacco rod 14 has loose ends; and (3) if the foil ring 24 in the cigarette is present.

Any condition which is not met ultimately operates to remove any selected cigarette from the product stream.

Inspection device 10 includes a rotating cigarette transport drum 30 with a plurality of equally spaced apart transverse cigarette receiving grooves 32 on the outside thereof. A pair of annular passageways 34 cuts across the receiving grooves 32, as shown best in FIG. 1. A vacuum tube 36 delivers vacuum to the cigarette receiving grooves 32 for the purpose of maintaining cigarettes 12 in selected grooves, as they are conveyed at rapid production speeds.

A sensing station 38 is located adjacent to the transport drum, and a mounting bracket 40 functions to support the sensing station at the desired location next to the drum. Sensing station 38 includes a U-shaped sensor bracket 42 constructed and positioned so that cigarettes on the transport drum pass between spaced apart arms 44, 46 of the sensor bracket. A plate 48 interconnects arms 44, 46, and the mounting bracket 40 may be connected to suitable framework 49. Machine parts 42, 44, 46 and 48 may be constructed as a single piece but could be made of any number of interconnected pieces.

Fiber optic sensors 50, 52 are secured to the arms 44, 46 of the U-shaped sensor bracket 42, one sensor to each arm. Both sensors are aimed at the ends of the cigarettes 12 in the cigarette receiving grooves 32 of drum 30. Sensor 50 is slightly higher in elevation than sensor 52 which enables sensor 50 to first inspect one end of cigarette 12 and immediately thereafter sensor 52 inspects the other end of the cigarette. In actuality, the difference in elevation of sensors 50, 52 is approximately equal to the diameter of cigarette 12. Fiber optic sensor 50 detects loose tobacco ends when present while fiber optic sensor 52 detects any missing filters 18. If detected, any cigarettes exhibiting those conditions are removed from the product stream. Also, the particular sensor positions may be reversed.

Figure 7:
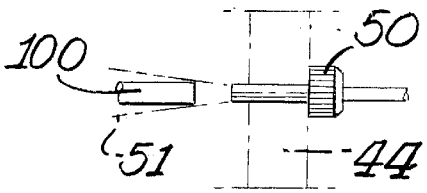
FIG. 7 is a view of one of the sensors and a tobacco rod illuminated thereby.

Fiber optic sensors 50, 52 are commercially available from Keyence Corporation of Osaka, Japan, and Keyence Corporation of America. Both sensors are fiber optic FU-35FA, and sensor 52 additionally includes a focusing lens also available from Keyence under number F-2HAX4. Sensor 50 is modified by removing the focusing lens as illustrated schematically in FIG. 7. Tobacco rod 100 is illuminated by a cone-shaped beam of light 51 from sensor 50. Optimally the rod 100 is positioned so that its circumference is substantially aligned with the edges of the light beam. The practice of the present invention includes positioning the rod 100 slightly closer or further away from the sensor 50 so long as the portion of the rod 100 most likely to have missing tobacco is illuminated. This arrangement permits the examination of the entire end of tobacco rod 100 at high machine speeds. It has been found that bathing the entire end of the rod 100 in light permits much faster data acquisition than is possible by using the focused light produced by the lens provided with the sensor. It will be appreciated that other sensors outfitted with a suitable lens capable of generating the light beam illustrated in FIG. 7 may be used in the practice of the present invention. For instance, lenses capable of generating a wide angle light beam could be provided. The selection of the proper sensor and, if desired, lens is within the ability of one of ordinary skill.

Sensing station 30 also includes inductive sensor 54 secured to connecting plate 48 of the U-shaped sensor bracket 42. Sensor 54 may be aimed at the center portion of the transverse cigarette receiving grooves 32 of the transport drum 30 where the metal foil band 24 of cigarette 12 is located. Sensor 54 senses the presence or absence of the foil band in each cigarette, and when the band is missing that cigarette is subsequently removed from the product stream.

Sensor 54 may be a commercially available sensor from Keyence Corporation of Osaka, Japan and Keyence Corporation of America, such as Keyence ET-308, and it may be used in combination with an amplifier, such as Keyence ET-90.

Cigarette inspection device 10 also includes a fourth sensor 56 in the form of an inductive sensor that provides machine timing information to determine the three conditions of detection, namely, loose tobacco ends and missing filters 18 and foil bands 24. Binary information from sensor 56 is then input to a small PLC for data reduction and rejection. As explained more fully below, the program in the PLC allows the tobacco end of each cigarette 12 to be scanned multiple times by fiber optic sensor 50, and eliminates optical sensing of the tobacco mat 16 which wraps tobacco 14. In addition, filter 18 sensing is done with fiber optic sensor 52 and foil 24 sensing is done with inductive sensor 54 at the same time as the loose end sensing. A shift register (not shown) is loaded with the resultant detection data, and a reject valve or similar device (not shown) may be operated to remove any faulty cigarette from the product stream.

Figure 5A:
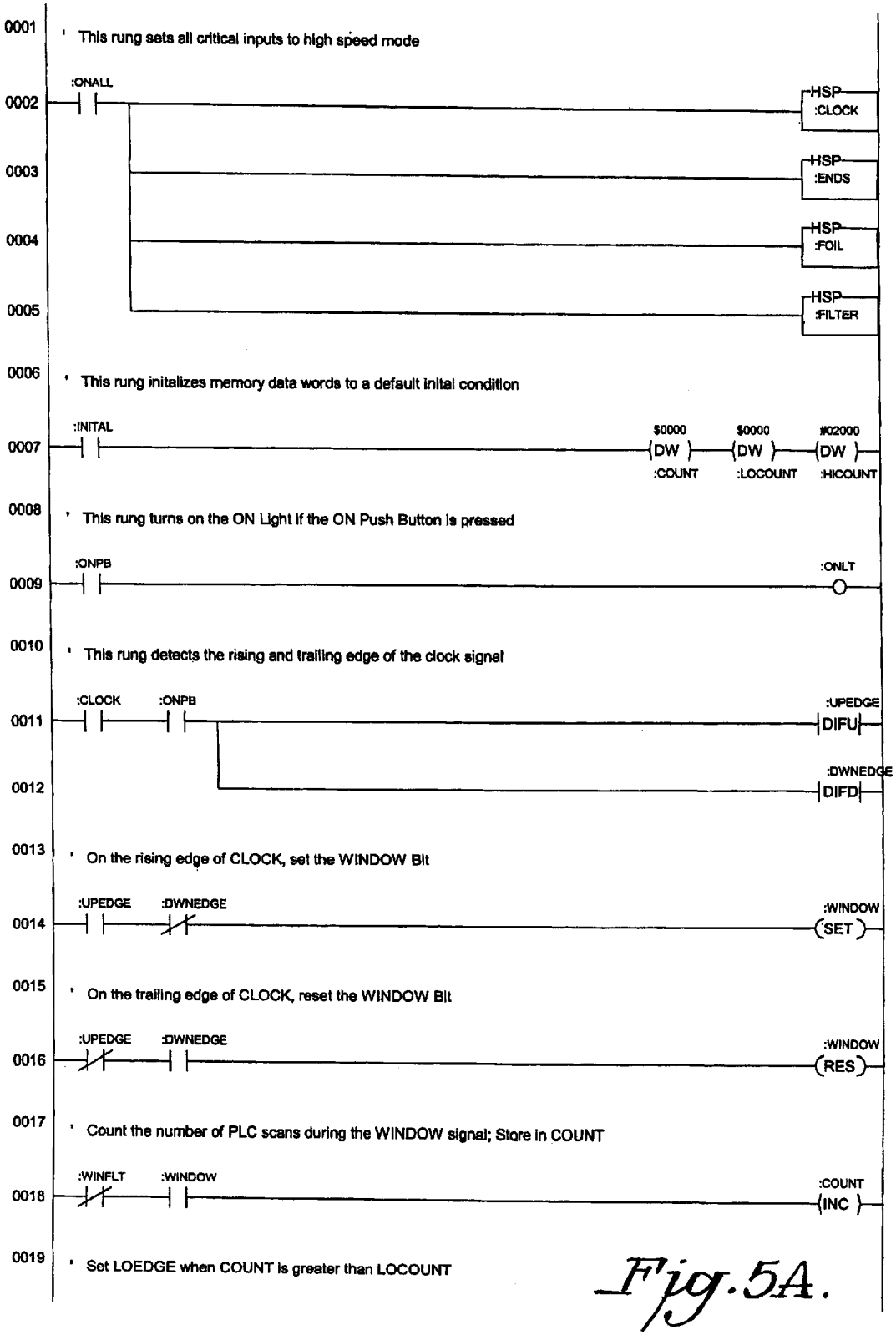
FIG. 5 is a ladder diagram of the operation of the cigarette inspection device, according to the present invention.
Figure 5B:
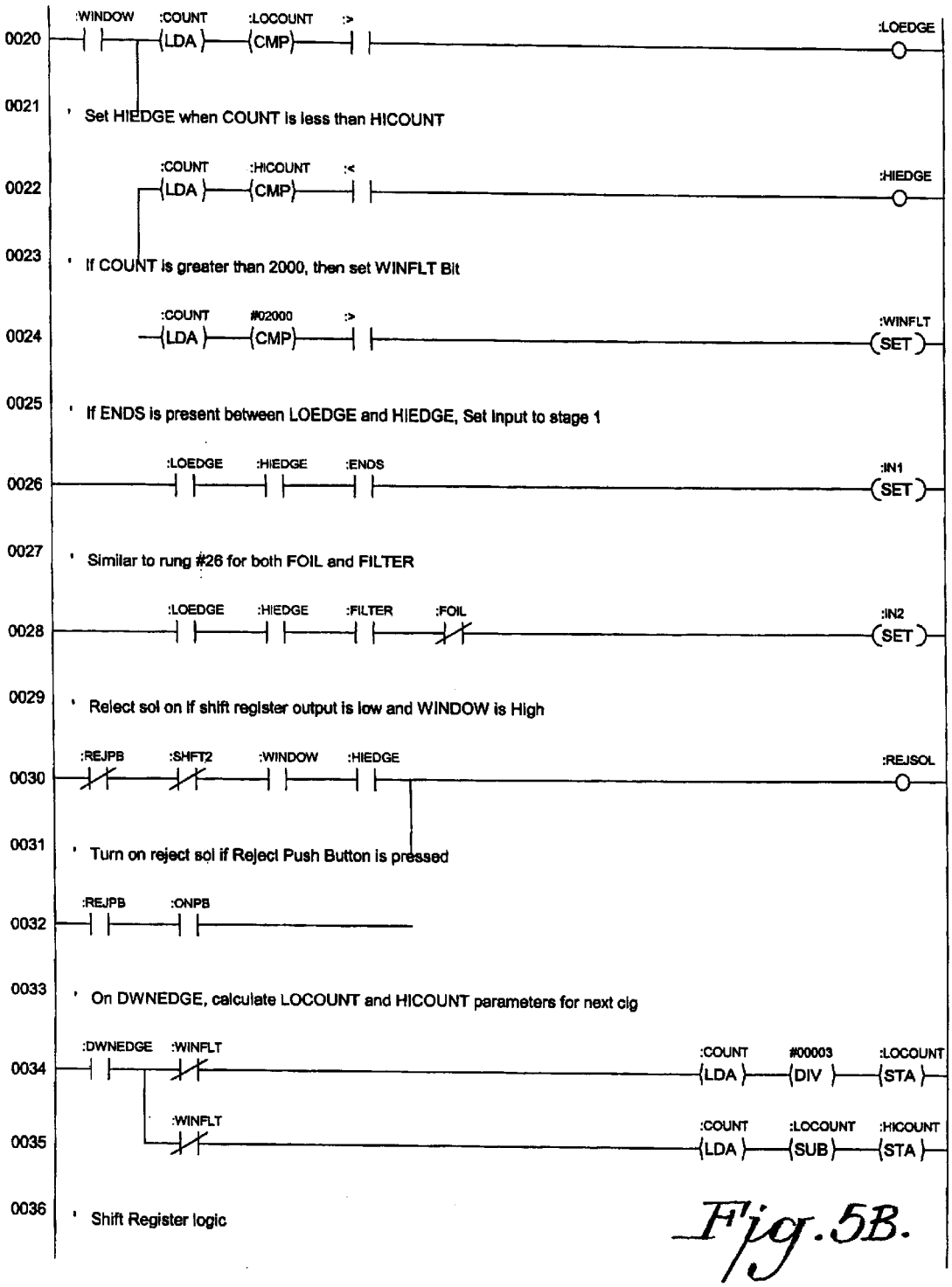
Figure 5C:
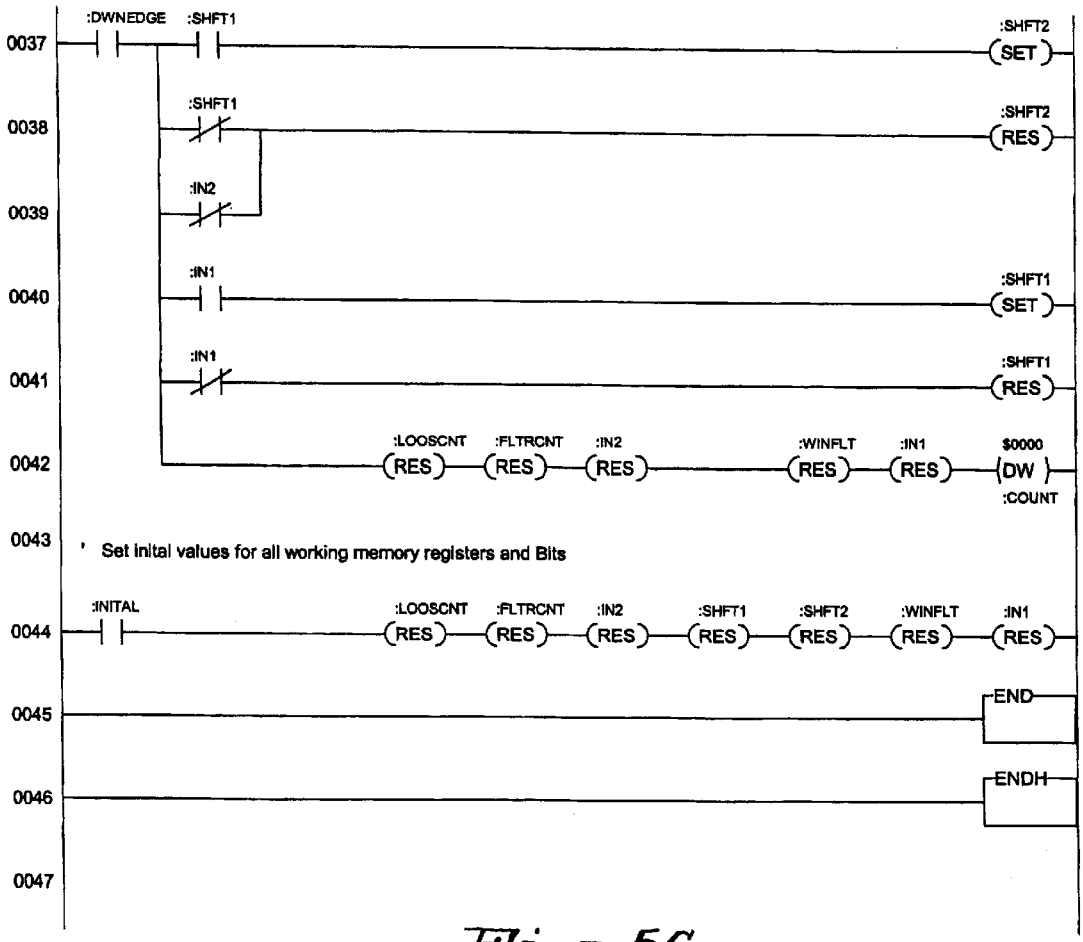

The following is an explanation of the ladder diagram of FIG. 5 illustrating operation of inspection device 10.

Rung By Rung Description

Rung 3 This rung sets up all critical inputs for the PLC to high speed mode. This insures that no input signals are missed.

Rung 9 This rung sets the memory locations for COUNT, LOCOUNT and HICOUNT to zero, zero and 2000. INITIAL is on for the first scan of the PLC.

Rung 11 Turns on the ON Light if the ON Push Button is pressed. The ON Push Button is a maintained Push Button.

Rung 13 This rung detects the rising and trailing edges of the machine synchronization signal CLOCK. CLOCK is derived from a toothed ring mounted on a machine drum, and an inductive proximity detector detects the toothed surface. UPEDGE and DOWNEDGE are logic true only on the transition of CLOCK for the respective edge conditions.

Rung 16 If UPEDGE is true and DOWNEDGE is not true, then Set WINDOW.

Rung 18 If UPEDGE is not true and DOWNEDGE is true, then reset WINDOW. WINDOW follows the CLOCK signal.

Rung 20 The COUNT is incremented for every scan of the PLC as long as WINDOW is present and there is no WINFLT. This number is then the total number of PLC scans during the WINDOW signal. COUNT will be used later in the program to determine when to sense the loose end, filter and foil inputs to the PLC. By doing this, the program can NOT SENSE the edge of the cigarette, which contains the tobacco sheet, and the loose end detector "looks at" the center portion of the cigarette where the tobacco filler is located.

Rung 24 This rung is the heart of the program. Every scan through the PLC as long as WINDOW is present, these lines compare the current scan count (COUNT) to the numbers LOCOUNT and HICOUNT and sets bits LOEDGE if COUNT is greater than LOCOUNT and HIEDGE if COUNT is less than HICOUNT. The COUNT number between LOCOUNT and HICOUNT is where the Loose End input is sensed. For example, if there are 6 scan counts, LOCOUNT is 2, and HICOUNT is 4, then the Loose End is sensed only during a Count value of 3. See Rung 39 for the calculations of LOCOUNT and HICOUNT, please.

Rung 29 This rung senses the Loose End. Between LOEDGE and HIEDGE, if the ENDS signal is present—a good cigarette—IN! (To the shift register) is set.

Rung 31 As in rung 29, both the FOIL and FILTER detectors are sensed in the same way. IN2 is the shift register input for the second stage. This is due to the mechanical offset of one flute in the sensor placement for both FOIL and FILTER.

Rung 35,36 This rung turns on the Reject Solenoid. For manual reject, REJPB (the REJECT Push Button) turns on the reject if the ON Push Button is on, and for automatic (normal operation), the output signal of the shift register (SHFT2) turns on the reject during WINDOW and HIEDGE. HIEDGE is used since the reject solenoid is slow during turnoff, and it is not desirable to blow off more than one cigarette at a time.

Rung 39,40 On the trailing edge of WINDOW, all work is done to setup for the next sensing operation on the next cigarette. The current COUNT is divided by 3, and stored into LOCOUNT, (COUNT–LOCOUNT) or ⅔ COUNT is stored into HICOUNT. All this happens if there is no WINFLT (COUNT is not greater than 2000), which means that the machine is going too slow to have product in it.

Rung 45,50 This is the shift register. There are two inputs, IN1 for the first stage, and IN2 for the second stage. Loose ends are input into IN1, and the (FOIL AND FILTER) are input into the second stage. If there are no inputs defined, the first stage is placed into the second stage, and IN1 is placed into Stage 1.

A logic zero SHIFT 2 means the cigarette will be rejected. The last line resets all working registers except LOCOUNT and HICOUNT for the next WINDOW signal.

Rung 52 An initialization rung for the memory working registers.

Figure 6:
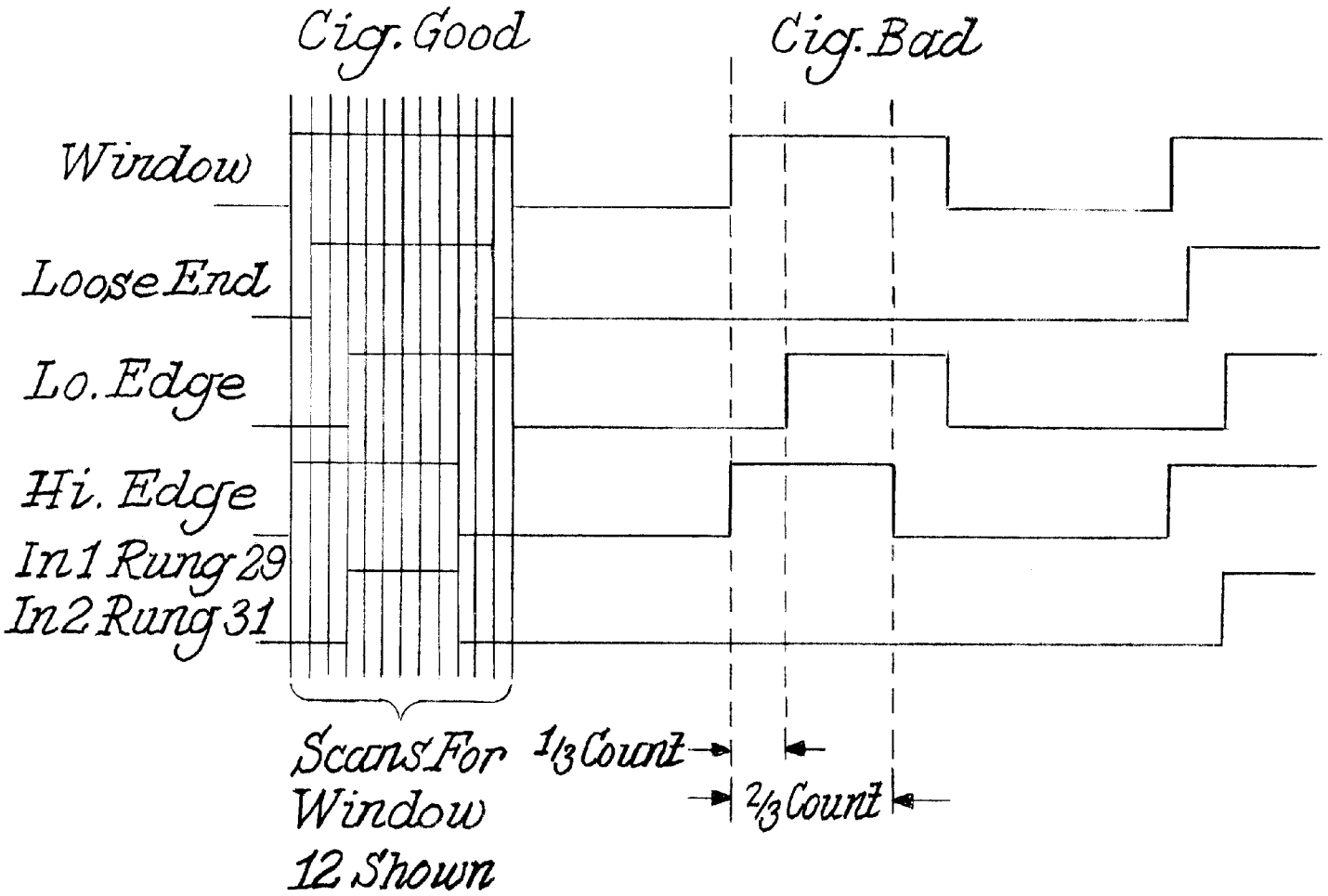
FIG. 6 is a basic timing diagram for loose tobacco end detection, according to the present invention.

FIG. 6 illustrates the basic timing diagram for loose tobacco end detection. In this diagram, 12 scans are shown. Typically, only six are present at the highest speed of the machine. LOOSE END, or the ENDS signal, is diagramed, but FOIL & FILTER are sensed the same way to set IN2. The edges of the cigarette are not sensed, due to the tobacco paper, or MAT, which would cause a false setting of IN1, and only the center part of the cigarette is sensed, where the actual tobacco filler is present. Since a new calculation of LOCOUNT and HICOUNT is done during the logic zero period of WINDOW, the program uses the $n^{th}$ cigarette to set the (n+1) cigarette parameters. The machine speed cannot be changed fast enough to foul up this calculation, yet if the speed changes slowly, the program will automatically change LOCOUNT and HICOUNT to always "look at" the center region of the cigarette, thus always sensing tobacco.

In general, WINDOW provides a mechanically timed signal that says to look for a cigarette during the WINDOW interval, and in the interval between WINDOWS(S), set up parameters for the next set of PLC scans on the next cigarette. PLC scans are typically 700 $\mu$sec each while the cigarette is in place to scan for about 4 msec. Also, shifting of the shift register is done during the logic low region of WINDOW. This sets the shift register output to turn on (or leave off, depending on IN1 and IN2) the reject solenoid during the next WINDOW signal.

What is claimed is:

1. A cigarette inspection device for inspecting individual cigarettes of a product stream comprising an inspection station and means for moving cigarettes through the inspection station, the inspection station including first sensing means for scanning one end of the cigarette for loose tobacco ends and producing a reject signal when loose ends are detected, second sensing means for scanning another end of the cigarette for the presence of cigarette filter structure and producing a reject signal when cigarette filter structure is missing, third sensing means for scanning a middle portion of the cigarette for the presence of a metal foil band and producing a reject signal when a metal foil band is missing, and fourth sensing means for providing machine timing information to reject and remove any faulty cigarettes from the product stream.

2. A cigarette inspection device as in claim 1 wherein the first, second and third sensing means each make at least six scans on each cigarette.

3. A cigarette inspection device as in claim 1 wherein the first and second sensing means each comprise fiber optic sensors.

4. A cigarette inspection device as in claim 1 wherein the third and fourth sensing means each comprise inductive sensors.

* * * * *